US010827800B2

(12) United States Patent
Iannuzzi

(10) Patent No.: US 10,827,800 B2
(45) Date of Patent: Nov. 10, 2020

(54) FOOTWEAR

(71) Applicant: ACBC S.R.L., Milan (IT)

(72) Inventor: Edoardo Iannuzzi, Milan (IT)

(73) Assignee: ACBC S.R.L., Milan (IT)

( * ) Notice: Subject to any disclaimer, the term of this patent is extended or adjusted under 35 U.S.C. 154(b) by 34 days.

(21) Appl. No.: 16/227,202

(22) Filed: Dec. 20, 2018

(65) Prior Publication Data

US 2019/0223555 A1 Jul. 25, 2019

(30) Foreign Application Priority Data

Jan. 23, 2018 (IT) ..... 102018000001667

(51) Int. Cl.

| | |
|---|---|
| ***A43B 3/24*** | (2006.01) |
| ***A43B 13/36*** | (2006.01) |
| ***A43C 11/12*** | (2006.01) |
| ***A43B 23/02*** | (2006.01) |
| ***A43B 13/14*** | (2006.01) |
| ***A43B 1/00*** | (2006.01) |

(52) U.S. Cl.

CPC ..... *A43B 13/36* (2013.01); *A43B 1/0027* (2013.01); *A43B 3/242* (2013.01); *A43B 3/244* (2013.01); *A43B 3/248* (2013.01); *A43B 13/14* (2013.01); *A43B 23/0245* (2013.01); *A43C 11/12* (2013.01)

(58) Field of Classification Search

CPC ..... A43B 3/24; A43B 3/242; A43B 3/244; A43B 13/36; A43C 11/12

USPC ..... 36/101

See application file for complete search history.

(56) References Cited

U.S. PATENT DOCUMENTS

| | | | | | |
|---|---|---|---|---|---|
| 2,302,596 | A * | 11/1942 | Bigio | A43B 3/24 | 36/101 |
| 2,491,930 | A * | 12/1949 | Parlante | A43B 3/24 | 36/101 |
| 2,493,154 | A * | 1/1950 | Mavrakis | A43B 3/24 | 36/101 |
| 3,972,136 | A * | 8/1976 | Epstein | A43B 3/10 | 36/101 |
| 4,745,693 | A * | 5/1988 | Brown | A43B 3/24 | 36/100 |
| 7,013,587 | B2 * | 3/2006 | Yama | A43B 13/36 | 36/101 |
| 7,614,165 | B2 * | 11/2009 | Curry | A43B 1/0081 | 36/101 |
| 9,596,903 | B2 * | 3/2017 | Byam | A43B 1/0081 | |

(Continued)

*Primary Examiner* — Sharon M Prange

(74) *Attorney, Agent, or Firm* — Arent Fox LLP; Michael Fainberg

(57) ABSTRACT

Footwear is provided and comprises a bottom part comprising a sole and an integral rear upper section, and a separate top part comprising a front upper section. The parts are releasably connected to each other by a releasable fastener. Each part provides a fastener half and each fastener half has a start and an end. The rear upper section of the bottom part includes a heel cap portion. The top part comprises two ends at a rear part thereof and the ends are connected by a strap positioned between the start and end of the top half fastener, and a movable flap is provided and extends over the inside surface of at least part of the heel cap portion. The releasable fastener is a zipper fastener, in which each fastener half has a zipper track with a plurality of teeth, and the number of teeth on the halves is exactly the same.

10 Claims, 25 Drawing Sheets

(56) References Cited

U.S. PATENT DOCUMENTS

| | | | | |
|---|---|---|---|---|
| 9,936,760 | B2 * | 4/2018 | Crary | A43B 3/0078 |
| 2004/0194349 | A1 * | 10/2004 | Delgatty | A43B 3/0078 36/101 |
| 2005/0229435 | A1 * | 10/2005 | Shih | A43B 3/24 36/101 |
| 2006/0272098 | A1 * | 12/2006 | Hochschild | A47C 27/001 5/727 |

* cited by examiner

TOP VIEW

SIDE VIEW

REAR VIEW

FRONT VIEW

SIDE VIEW

REAR VIEW

GROUP 1

- + 1 TOOTH COMPARED TO STANDARD
- + 2 TEETH COMPARED TO STANDARD
- + 3 TEETH COMPARED TO STANDARD

GROUP 2

- + 1 TOOTH COMPARED TO STANDARD
- + 2 TEETH COMPARED TO STANDARD
- + 3 TEETH COMPARED TO STANDARD

GROUP 5

- + 1 TOOTH COMPARED TO STANDARD
- + 2 TEETH COMPARED TO STANDARD
- + 3 TEETH COMPARED TO STANDARD

FOOTWEAR

CROSS-REFERENCE TO RELATED APPLICATIONS

This application claims priority to Italian Patent Application No. 102018000001667 filed on Jan. 23, 2018, the entire contents of which is hereby incorporated by reference.

FIELD OF THE INVENTION

The present invention relates generally to footwear and in particular to footwear comprising a multi-partite article with separable and interchangeable parts.

More specifically, the present invention relates to footwear according to the preamble of claim 1.

SUMMARY OF THE INVENTION

The present invention seeks to provide improvements in or relating to footwear, such as a shoe, boot, slipper or like foot covering.

An aspect of the present invention provides footwear comprising a bottom part comprising a sole and an integral rear upper section, and a separate top part comprising a front upper section, the parts being releasably connected to each other by a releasable fastener, wherein the top part comprises two ends at a rear part thereof and the ends are connected by a strap.

A further aspect provides footwear comprising a bottom part comprising a sole and an integral rear upper section, and a separate top part comprising a front upper section, the parts being releasably connected to each other by a releasable fastener, each part providing a fastener half and each fastener half having a start and an end, in which the top part includes a strap positioned between the start and end of the top half fastener.

A further aspect provides footwear comprising a bottom part comprising a sole and an integral rear upper section, and a separate top part comprising a front upper section, the parts being releasably connected to each other by a releasable fastener, in which the rear upper section of the bottom part includes a heel cap portion, in which a movable flap is provided and extends over the inside surface of at least part of the heel cap portion.

The top and bottom parts may each provide a half of the fastener and the fastener halves have a start and a finish, and the flap extends over at least the insides of starts and finishes of the halves when the top and bottom parts are joined together.

The flap may extend down over the outside face of the heel cap portion. In some embodiments the flap is connected at or near to the sole inside the bottom part.

The flap may flexible and movable between a fastened position and an unfastened position.

A fastener may be provided on the outside face of the heel cap portion for securing the flap in the fastened position. The fastener may be a snap fastener.

The start and finish of the releasable fastener may be separated by a portion of a heel cap portion and located at or towards the top of the heel cap portion sides.

The integral rear upper section may comprise a heel counter.

The integral rear upper section may comprise at least part of a quarter.

The integral rear upper section may comprise part of a vamp.

The front upper section may comprise at least part of a vamp.

In some embodiments only two parts are provided i.e. the footwear consists of the top and bottom parts.

The upper part may comprise a lacing arrangement.

In some embodiments the releasable fastener is a zip.

The rear upper section of the bottom part may include a heel cap portion located at the back thereof.

The heel cap portion may merge into a partial quarter and vamp portion which extends around the sides and front of the sole, upstanding therefrom.

The start and finish of the releasable fastener may be located at the back of the shoe, separated by a portion of the heel cap portion, and located at or towards the top of the heel cap portion sides.

A further aspect provides footwear comprising a bottom part comprising a sole and an integral rear upper section, and a separate top part comprising a front upper section, the parts being releasably connected to each other by a zipper fastener, each part providing a fastener half, in which each fastener half has a zipper track with plurality of teeth, and in which the number of teeth on the halves is exactly the same.

A further aspect provides a method of sorting zipper track halves into groups, for example based on teeth number and/or length. The method may comprise the step of using zipper halves from matched groups into match pairs for use in conjunction with shoe parts/halves formed in accordance with the present invention.

According to a further aspect of the present invention there is provided footwear comprising a bottom part comprising a sole and an integral rear upper section, and a separate top part comprising a front upper section, the parts being releasably connected to each other.

The integral rear upper section may comprise a heel counter.

The integral rear upper section may comprise at least part of a quarter.

The integral rear upper section may comprise part of a vamp.

The front upper section may comprise at least part of a vamp.

The present invention also provides a bottom part suitable for footwear as described herein.

The present invention also provides a top part suitable for footwear as described herein.

The footwear may comprise, for example, a shoe, trainer, boot or the like.

A further aspect provides a shoe comprising a lower part comprising a sole and a heel counter, and a separate upper part comprising at least part of a vamp, the lower and upper parts being detachably attached together.

In some embodiments only two parts are provided.

The lower part may comprise at least part of a shoe quarter.

The upper part may comprise a lacing arrangement.

The lower part may comprise part of the vamp.

In aspects and embodiments of the present invention the parts may be joined by a releasable fastener such as a zip.

Either or both ends of the fastener may be located at or towards top of the lower or bottom part.

The path of the fastener may be formed so as to provide resistance to water entry.

The path of the zip may be designed to guarantee waterproof resistance.

In some embodiments the path of the zip is specifically designed to guarantee waterproof resistance.

The present invention also provides a lower part suitable for a shoe as described herein.

The present invention also provides an upper part suitable for a shoe as described herein.

The present invention also provides a pair of shoes or footwear as described herein.

Other parts of a shoe/footwear which may be provided by either or both primary (or only) parts (separately or together) include: a heel; a welt; a counter; a cuff; a tongue; a quarter; laces; eyelets; a sole; a vamp; a toe; a footbed.

The present invention also provides an interchangeable shoe part system, for example allowing a shoe to be separated into two fundamental parts: a bottom part composed by a sole attached to a lower part of a shoe vamp; and an upper part composed by an upper part of a shoe vamp. The parts may be joined to each other by a fastener such as a zip. This means that the two parts are divisible and interchangeable so that different upper parts can be selected and mated with different lower parts to change the look and/or function of the shoe.

The present invention may allow the user to purchase a new upper and/or lower part. Because the shoe system is made by modular and interchangeable parts top and/or bottom parts can be reused and new combinations can be formed.

In some embodiments the upper part can be made so as to be generally flat when not attached to a lower part; this reduces the space required for storing and transporting.

Different aspects and embodiments of invention be used separately or together.

Further particular and preferred aspects of the present invention are set out in the accompanying independent and dependent claims. Features of the dependent claims may be combined with the features of the independent claims as appropriate, and in combination other than those explicitly set out in the claims.

BRIEF DESCRIPTION OF THE DRAWINGS

The present invention will now be more particularly described, by way of example, with reference to the accompanying drawings.

FIGS. 14, 13, 14, 15 and 16 show a bottom shoe part of the shoe of FIGS. 9 to 13 when fully separated from the top part which is shown in FIG. 17;

DETAILED DESCRIPTION OF PREFERRED EMBODIMENTS

Figure 1:
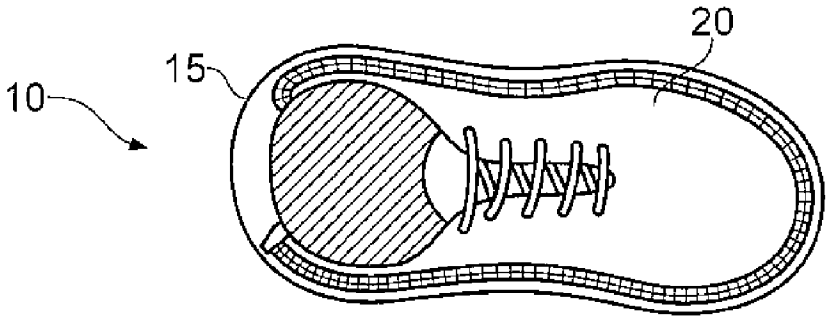
FIGS. 1, 2, 3 and 4 show top, back, side and front views, respectively, of a shoe formed according to the present invention.
Figure 3:
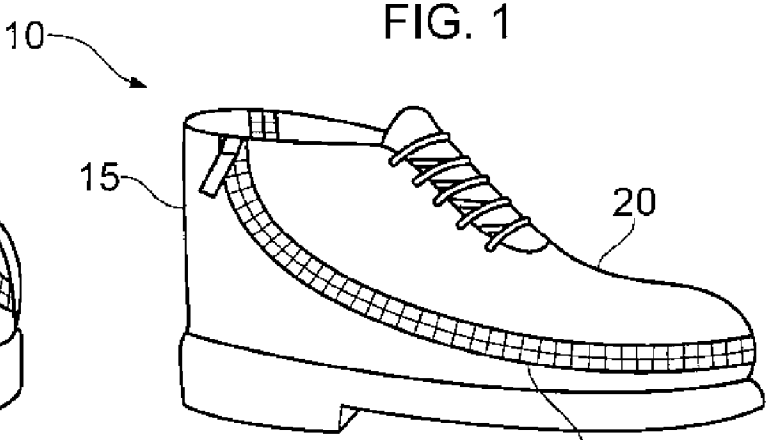
Figure 2:
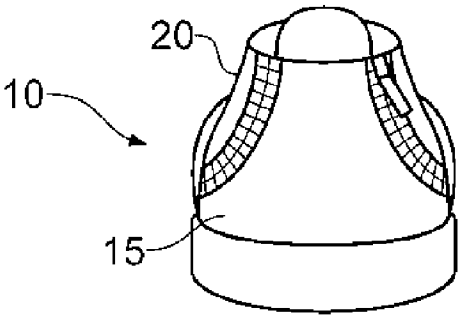
Figure 4:
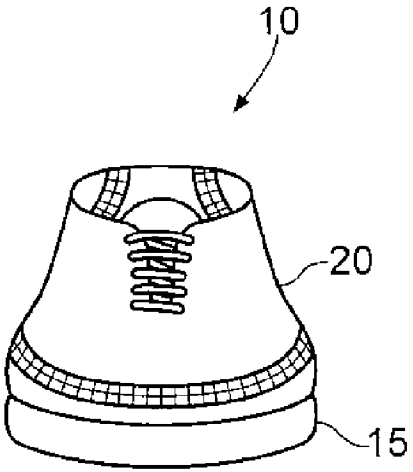
Figure 5:
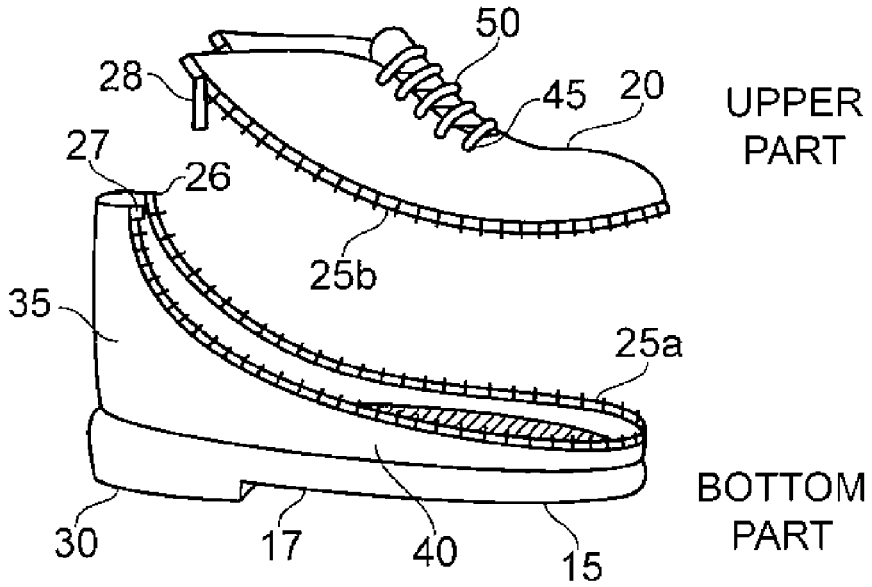
FIGS. 5, 6, 7 and 8 show exploded side, back, top and front views, respectively, of the shoe of FIGS. 1 to 4.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Referring first to FIGS. 1 to 4 there is shown a shoe generally indicated 10. In this embodiment the shoe 10 comprises a bottom part 15 and an upper part 20.

The parts 15, 20 are formed separately and attached to each other by a releaseable fastener, which in this embodiment is a zip 25.

Referring now also to FIGS. 5 to 8 the parts 15, 20 are described in more detail.

The bottom part 15 comprises a sole 17 and a heel 30. In addition the part 15 comprises a heelcap portion 35 which extends and effectively merges into a partial quarter and vamp portion 40 which extends around the sides and front of the sole, upstanding therefrom.

One half 25*a* of the zip fastener 25 extends (for example like a collar) along the exposed periphery of the heelcap 35 and quarter/vamp region 40.

The start 26 of the zip and the finish 27 are both at the top of the heelcap 35 and therefore are spaced from the interface with the sole 17.

The upper part 20 is correspondingly shaped to complete the toe, vamp, quarter and heelcap regions of the shoe. It can be seen folded flat in FIG. 7 and is effectively a flap material.

The periphery of the part 20 is provided with the matching half 25*b* of the zip fastener and also has a start 23 and a finish 22. In this embodiment the upper part 20 is provided with the zip pull 28.

In this embodiment the upper part 20 is provided with eyelets 45 for receiving laces 50.

In use, the upper part 20 is connected to the bottom part 15 by offering it to the bottom part and connecting the zip puller 28 to the zip start 27 of the bottom part. Thereafter the puller 28 is moved along the zip path and around to the finish 26 to secure the parts 15, 20 together are shown in FIGS. 1 to 4.

Figure 6:
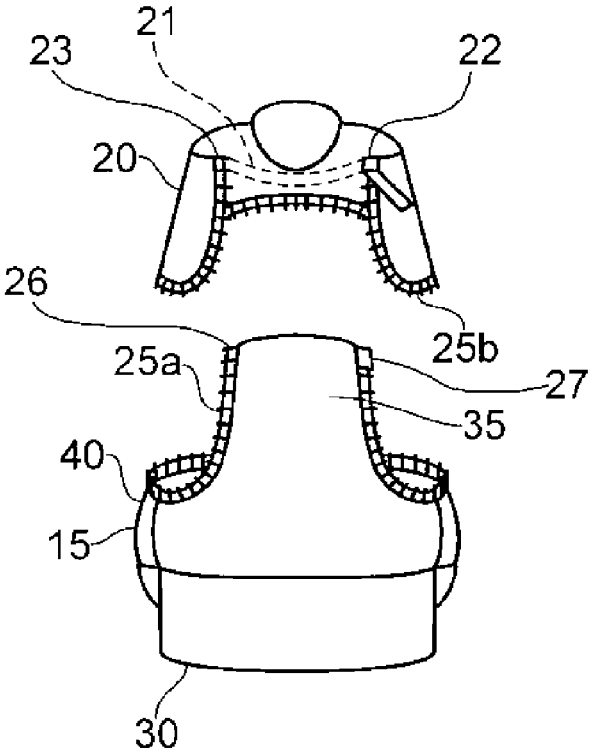
Figure 7:
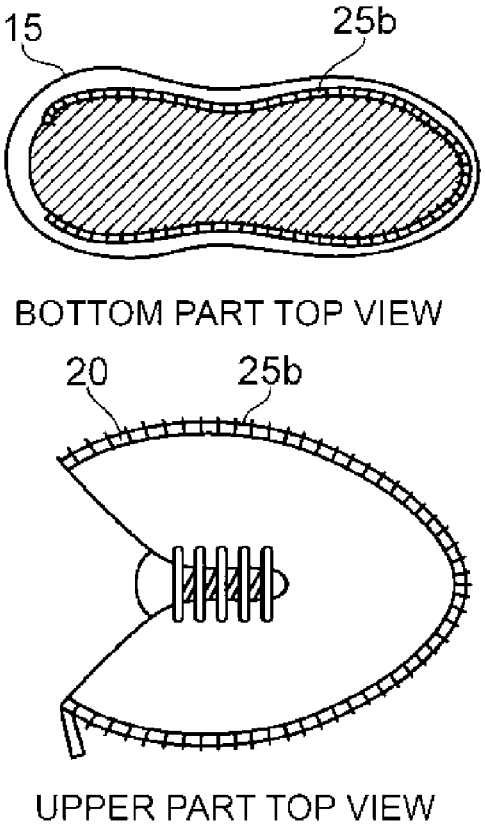
Figure 8:
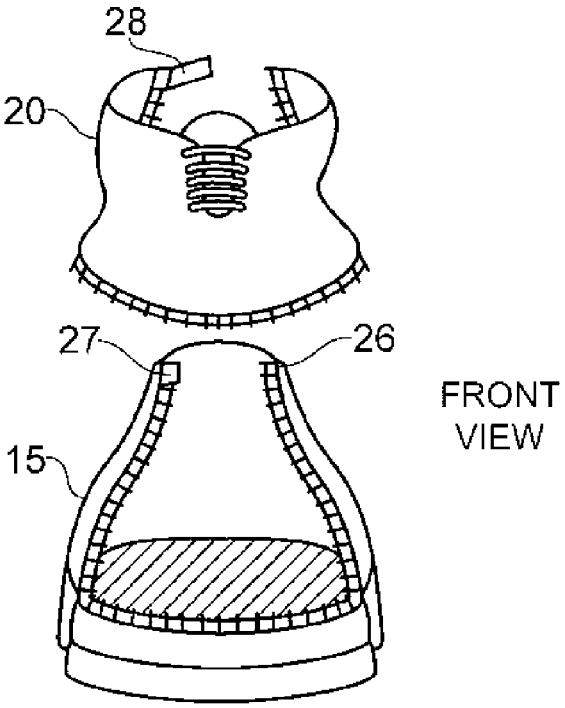

FIG. 6 shows the top part 20 with an optional strap 21 that extends between the start 23 and finish 22 of the zipper track 25*b*.

Figure 10:
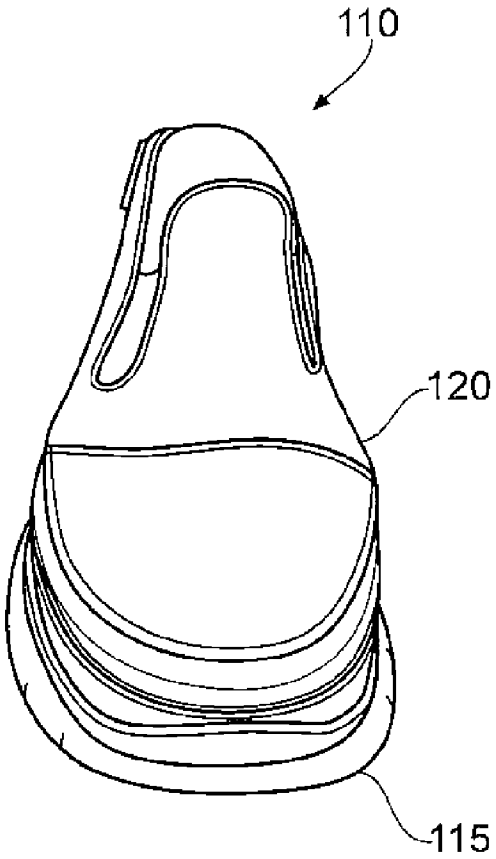
FIGS. 9 and 10 show side and front views of a two-part shoe formed in accordance with an embodiment of the present invention.
Figure 9:
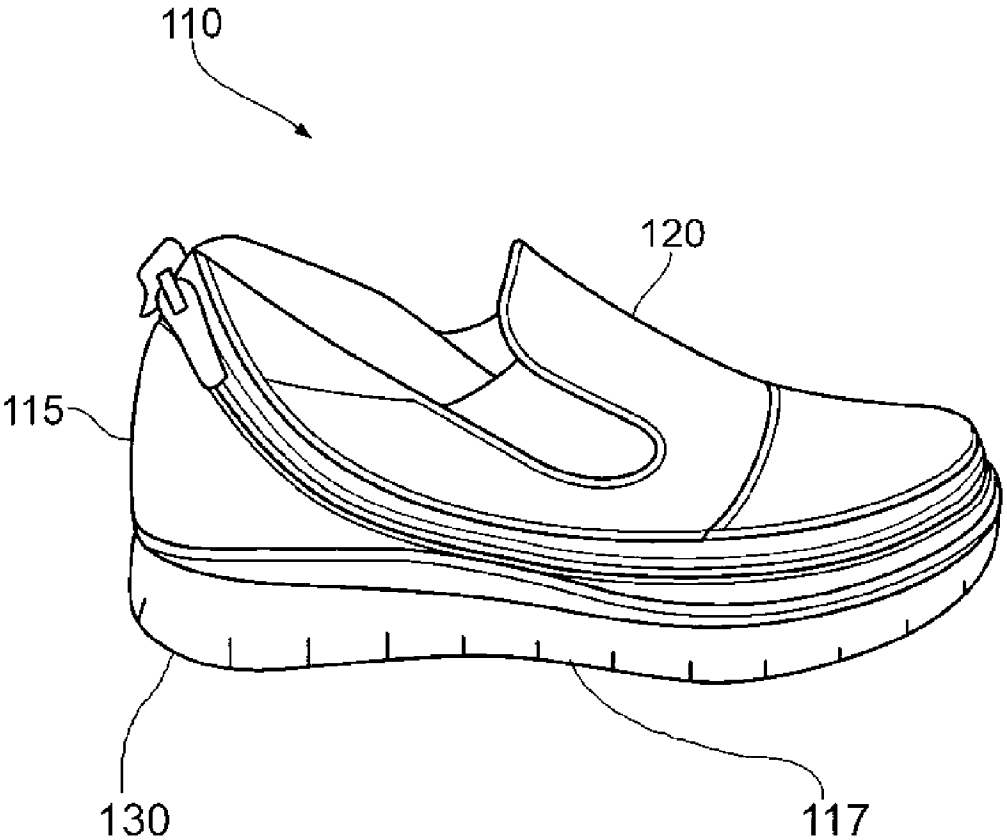

In FIGS. 9 and 10 a shoe 110 formed according to an alternative embodiment is shown. The shoe 110 is similar to the shoe 10 shown in FIGS. 1 to 8. In this embodiment the shoe is formed as a "slip-on" type shoe rather than a "lace-up" type shoe.

In this embodiment the sole 117 and heel region 130 are formed together.

Figure 11:
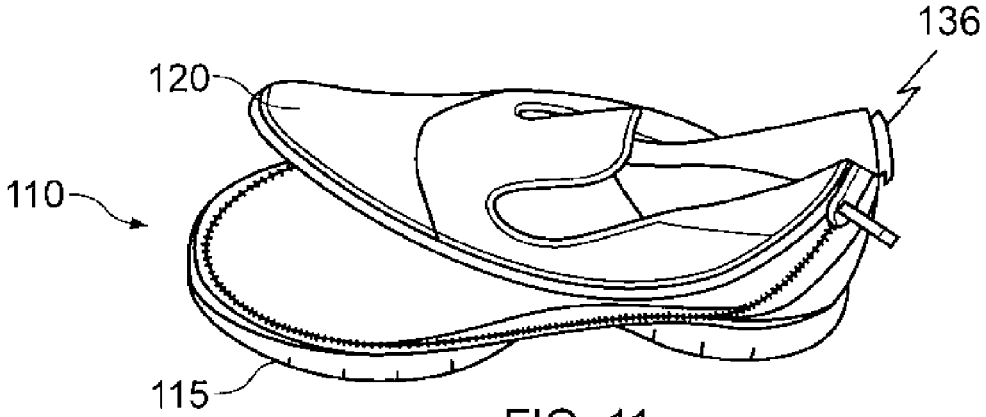
FIGS. 11, 12 and 13 show the shoe of FIGS. 9 to 10 in partially unzipped states.
Figure 12:
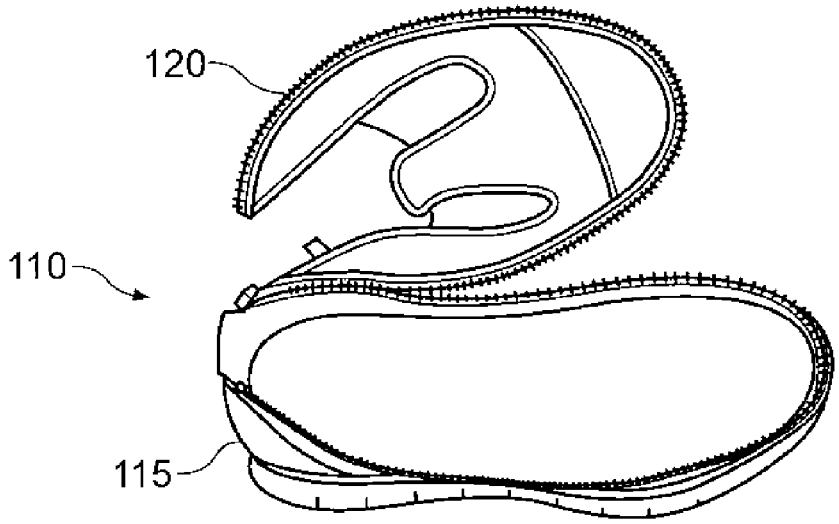
Figure 13:
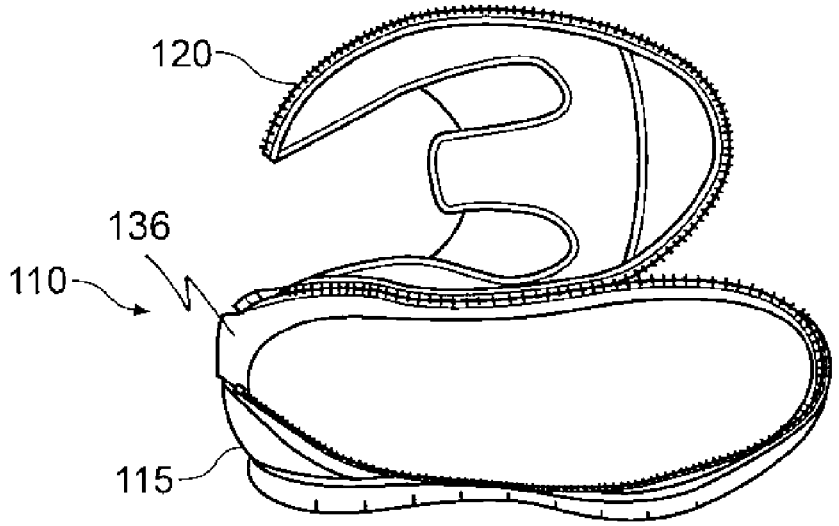

FIGS. 11 to 13 show the shoe 110 as it is unzipped to form the lower 115 and upper 120 components shown separately in FIGS. 14 to 16 and 17 respectively.

The inside face of the lower part heel cap portion 135 is provided with a rear comfort flap 136. The flap 136 extends over the inside face of the portion 135 and helps to prevent the ends of the zipper tracks from rubbing against the wearer's foot or ankle in use. In this embodiment the flap 136 extends over the top of the heel cap portion and partly down the outside face of the portion.

Figure 14:
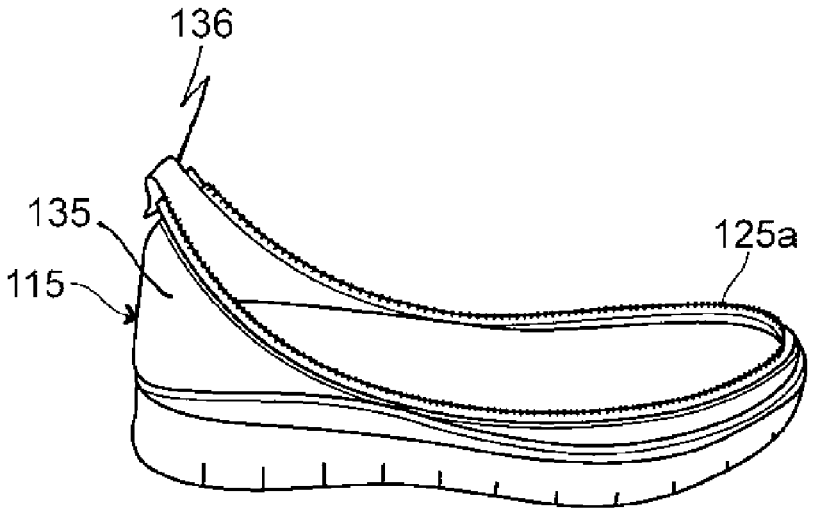
Figure 15:
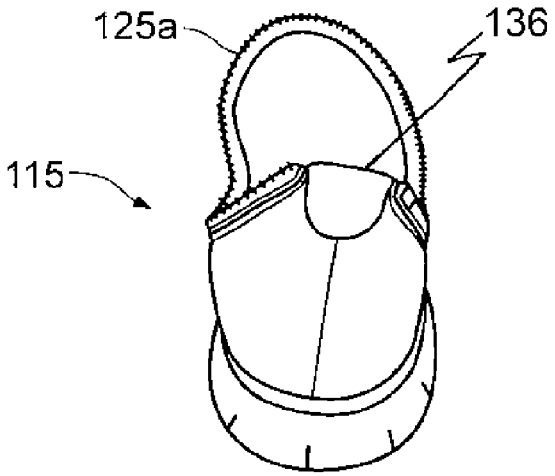
Figure 16:
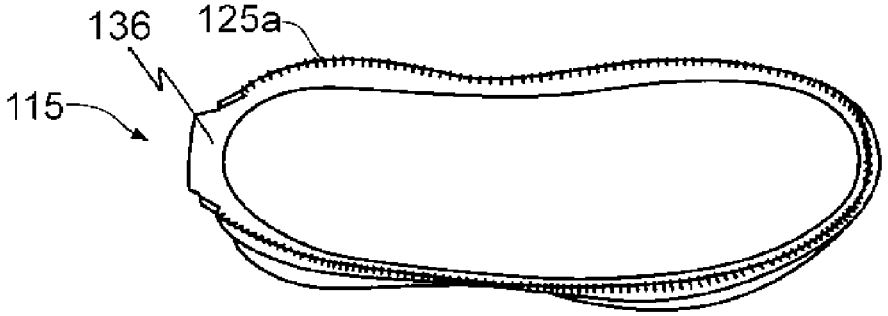
Figure 17:
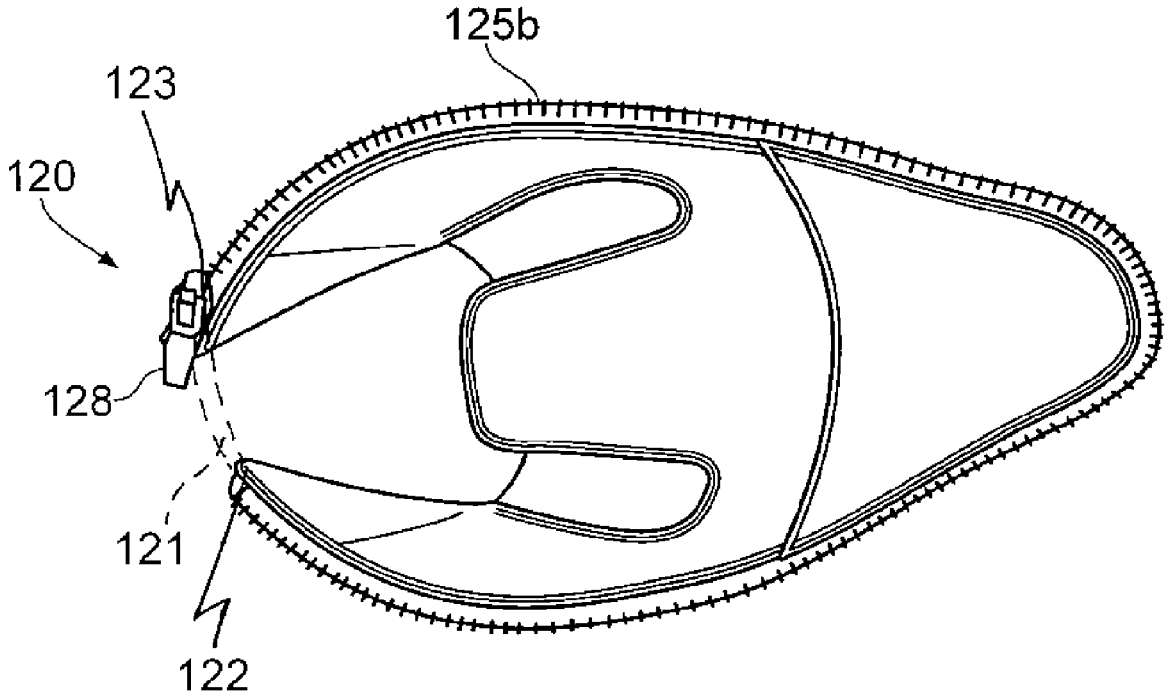
FIG. 17 shows a top part of the shoe of FIGS. 9 to 13.
Figure 18:
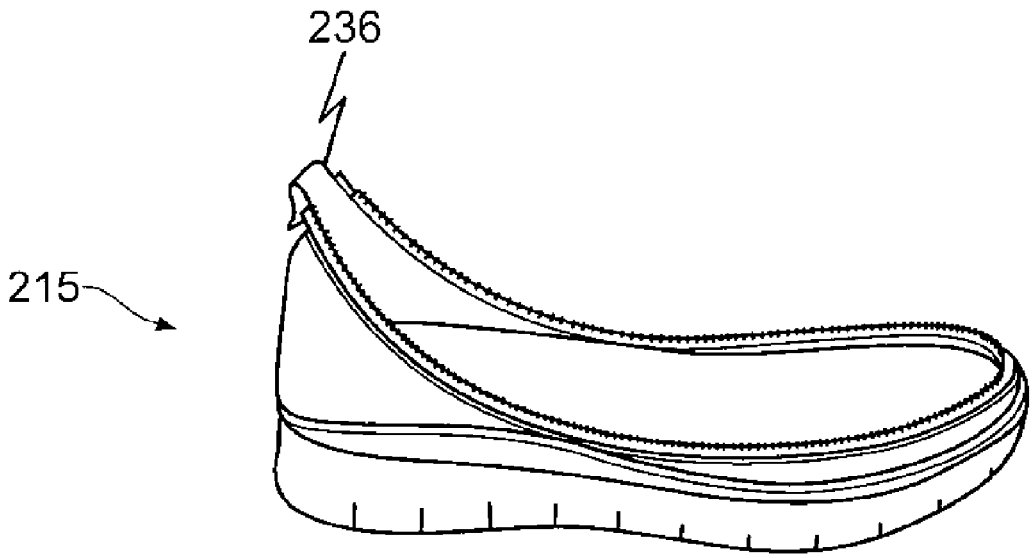
FIG. 18 shows a lower part of the same type as that shown in FIG. 14 to 16 together with a different upper part shown in FIG. 19.
Figure 19:
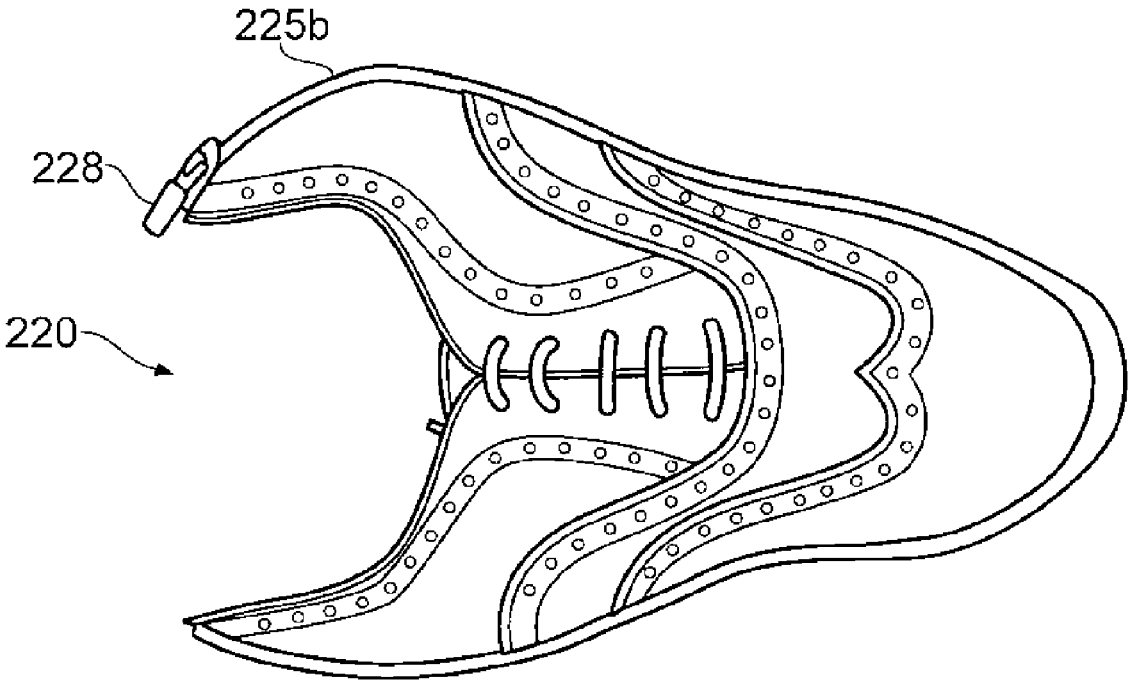
FIG. 19 shows a different upper part for a shoe in FIG. 18.
Figure 21:
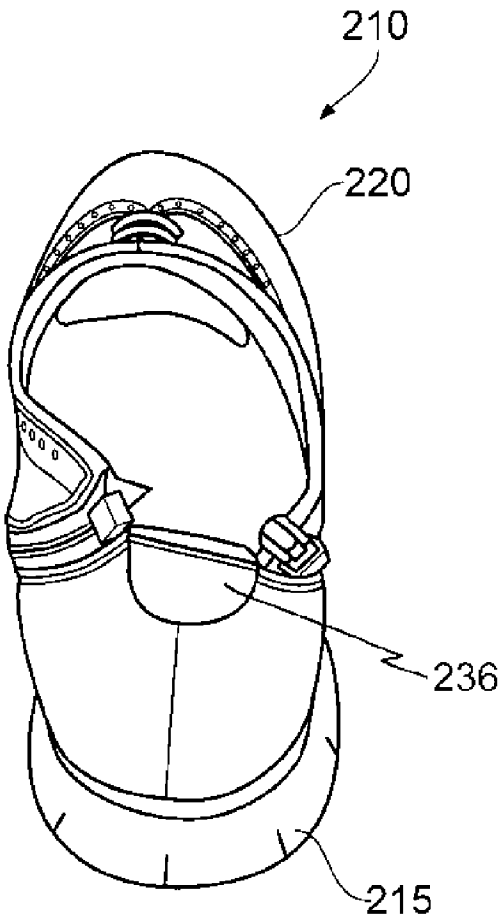
FIGS. 20 and 21 show side and rear views of a fully assembled shoe formed from the lower and upper parts of FIGS. 18 and 19.
Figure 20:
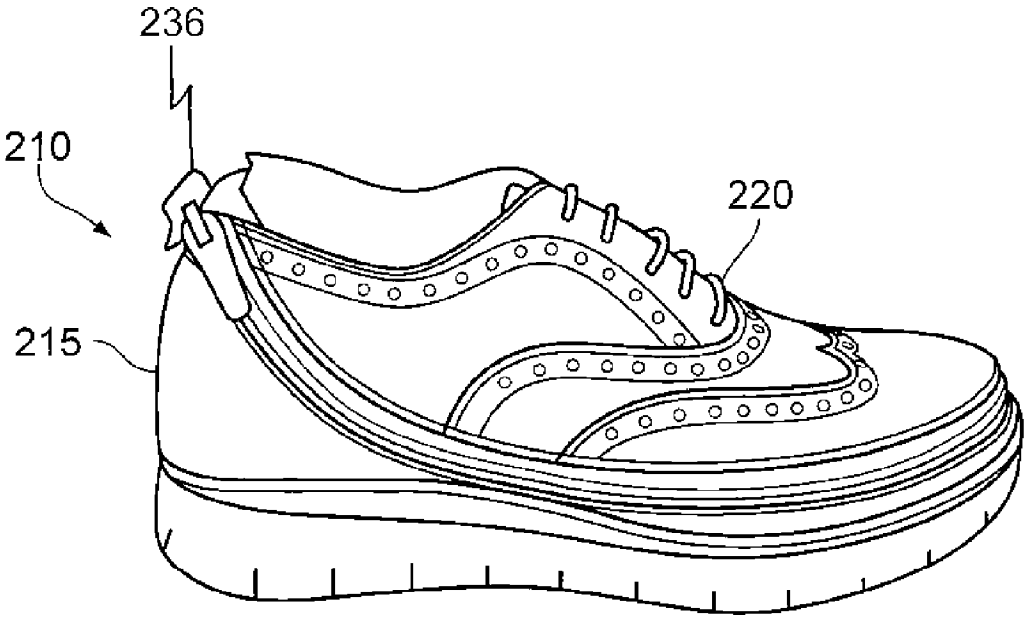

In FIG. 18 a lower part 215 of the type shown in FIGS. 14 to 16 is provided. A different upper part 220 is shown in FIG. 19. The part 220 has the same half fastener arrangement as the part 120 shown in FIG. 17 and accordingly it can be secured in the same way to the part 215 as shown in FIGS. 20, 21. This means that parts such as those shown in FIGS. 17 and 19 can be used with the same part of the type shown in FIG. 18, and by extension upper parts can be used with different lower parts, all bearing the same corresponding attachment means.

The lower part 215 is again provided with a rear comfort flap 236.

FIG. 17 shows the top part 120 with an optional strap 121 that extends between the start 123 and finish 122 of the zipper track 125*b*.

FIGS. 22 to 31 illustrate two technological innovations incorporated at the back of the shoe:

FIGS. 22 to 29 show a (for example leather) flap on the back of the shoe that covers the raw edges of the skin's back ends and, where provided, the fabric strap making the back of the shoe more comfortable and aesthetically pleasing. The back flap that makes the shoe more comfortable by covering the fabric raw edges and the zipper ends. It would be very uncomfortable to touch those raw edges with the heel of the foot. The back flap is useful for both comfort of the foot and aesthetics.

Figure 30:
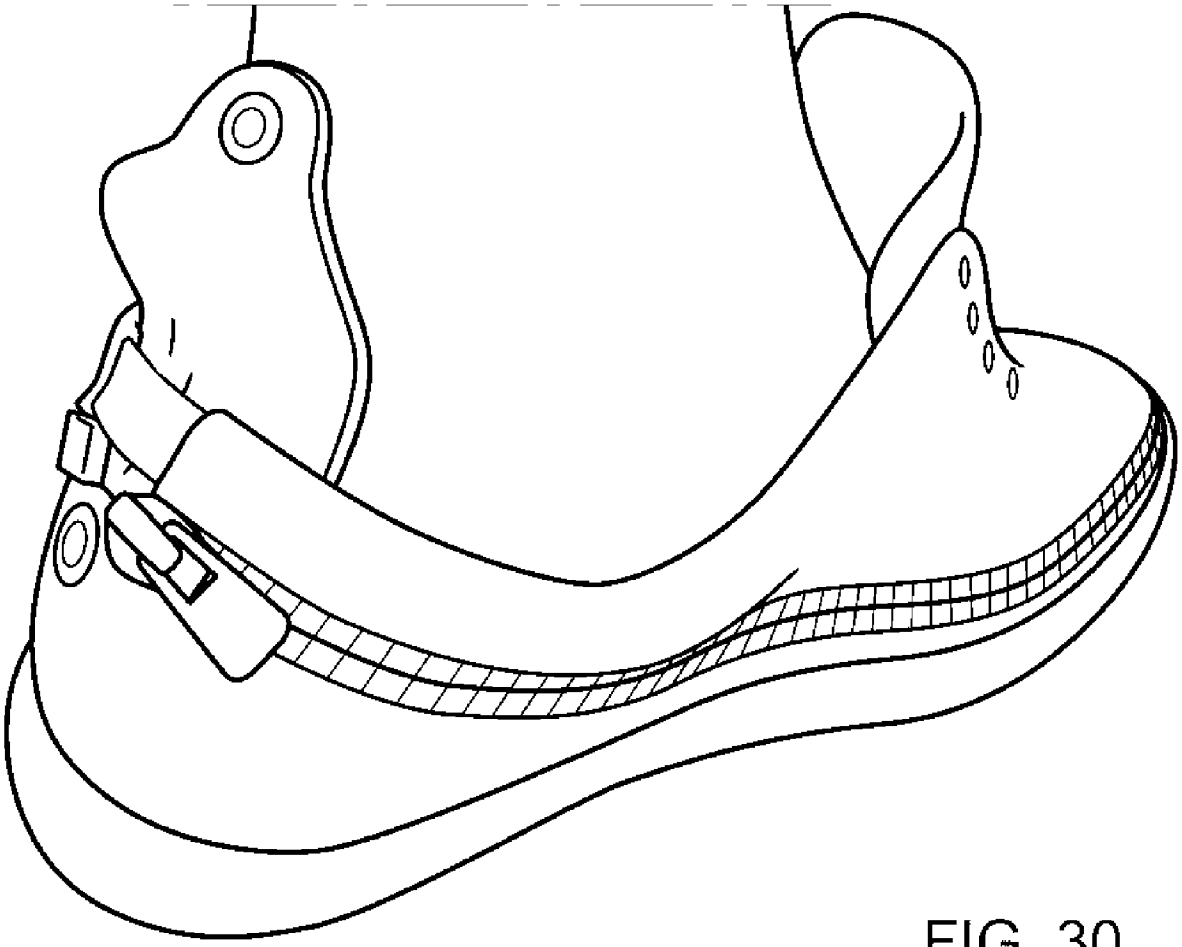
FIGS. 30 and 31 illustrate a stress relieving strap for an upper skin part formed in accordance with the present invention.
Figure 31:
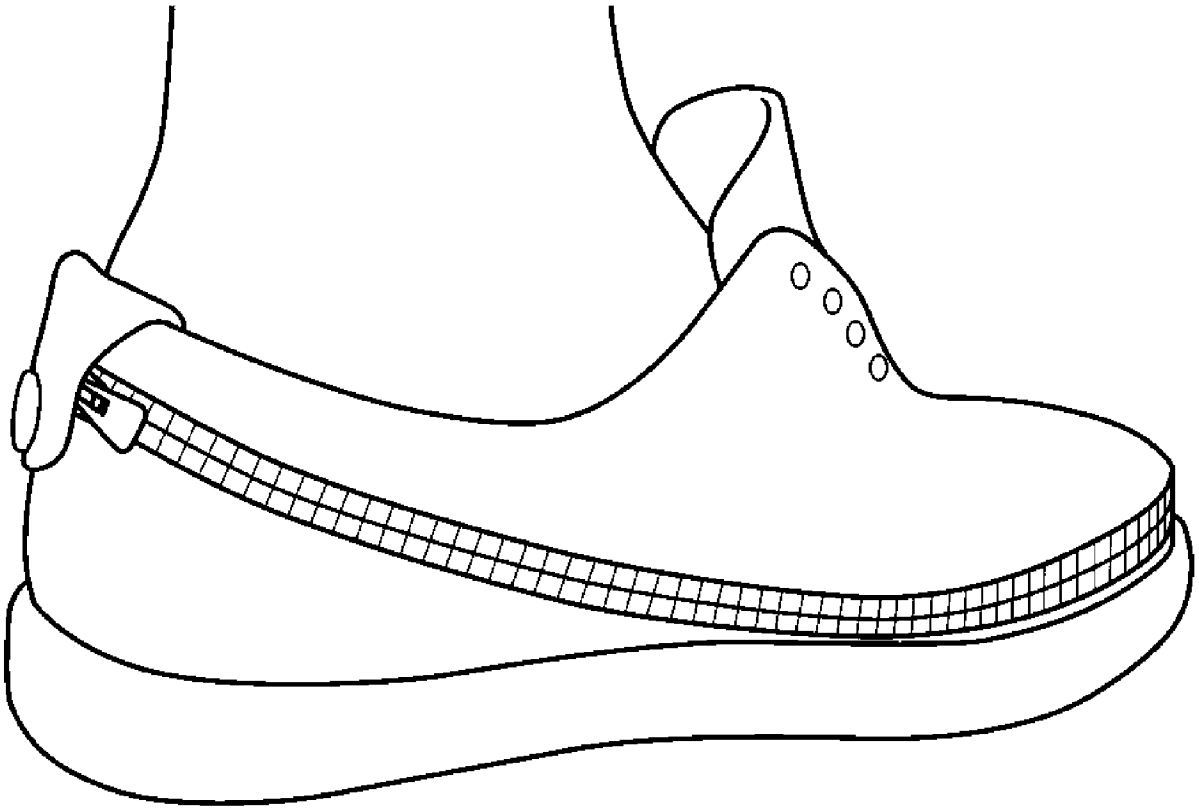
Figure 32:
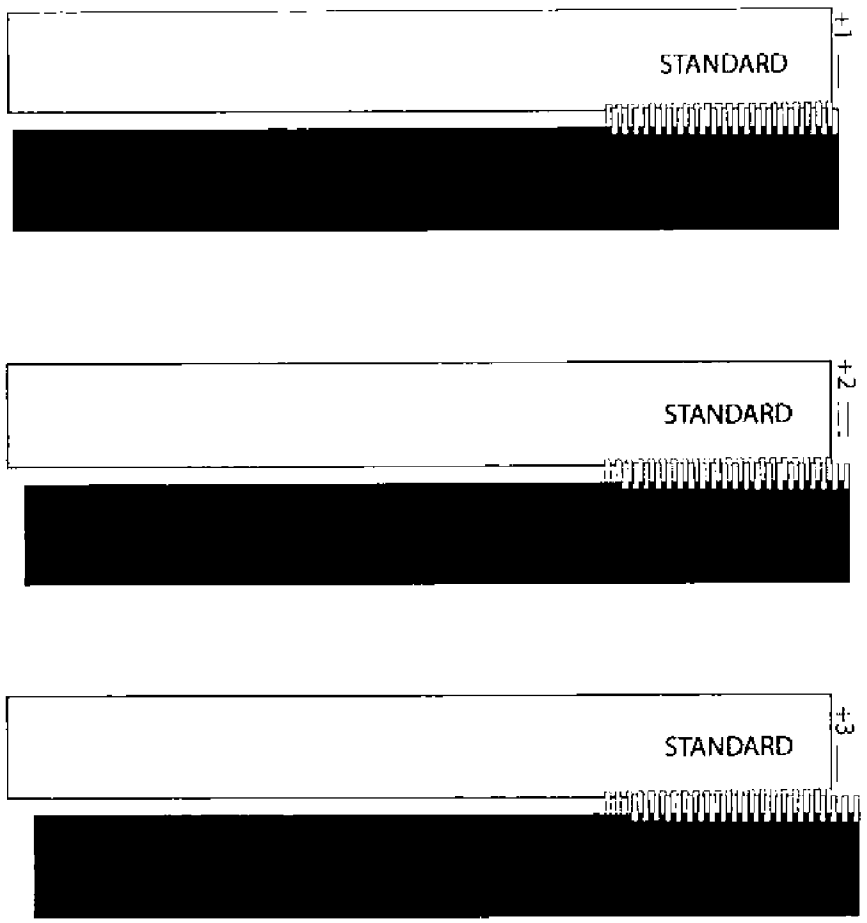
FIGS. 32, 33, 34, 35 and 36 illustrate the sorting of zipper halves into groups based on teeth number.
Figure 33:
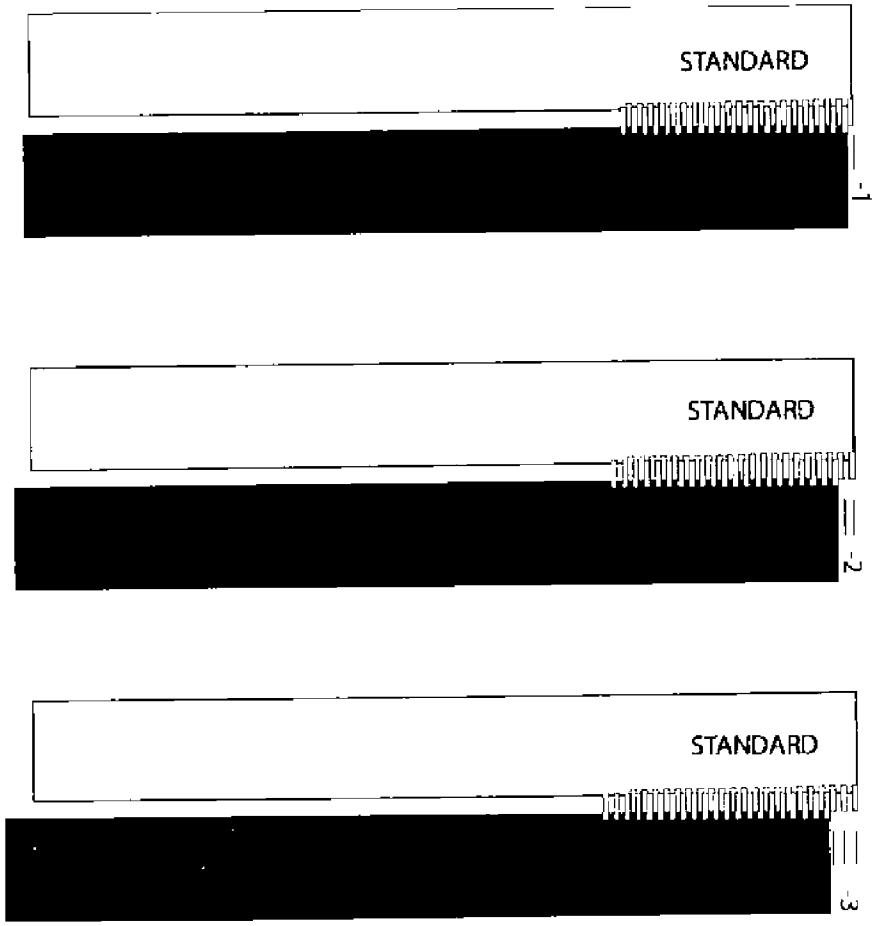
Figure 34:
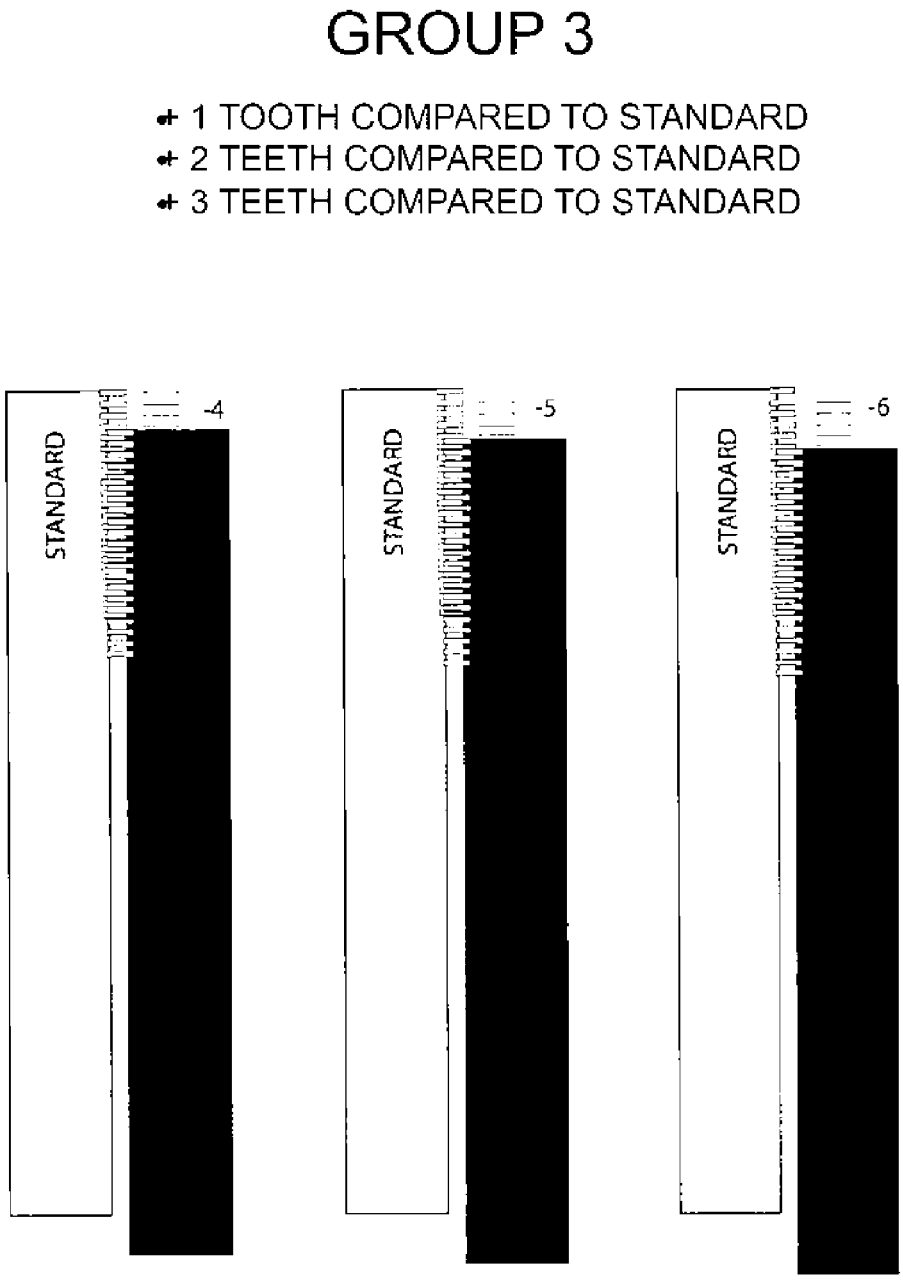
Figure 35:
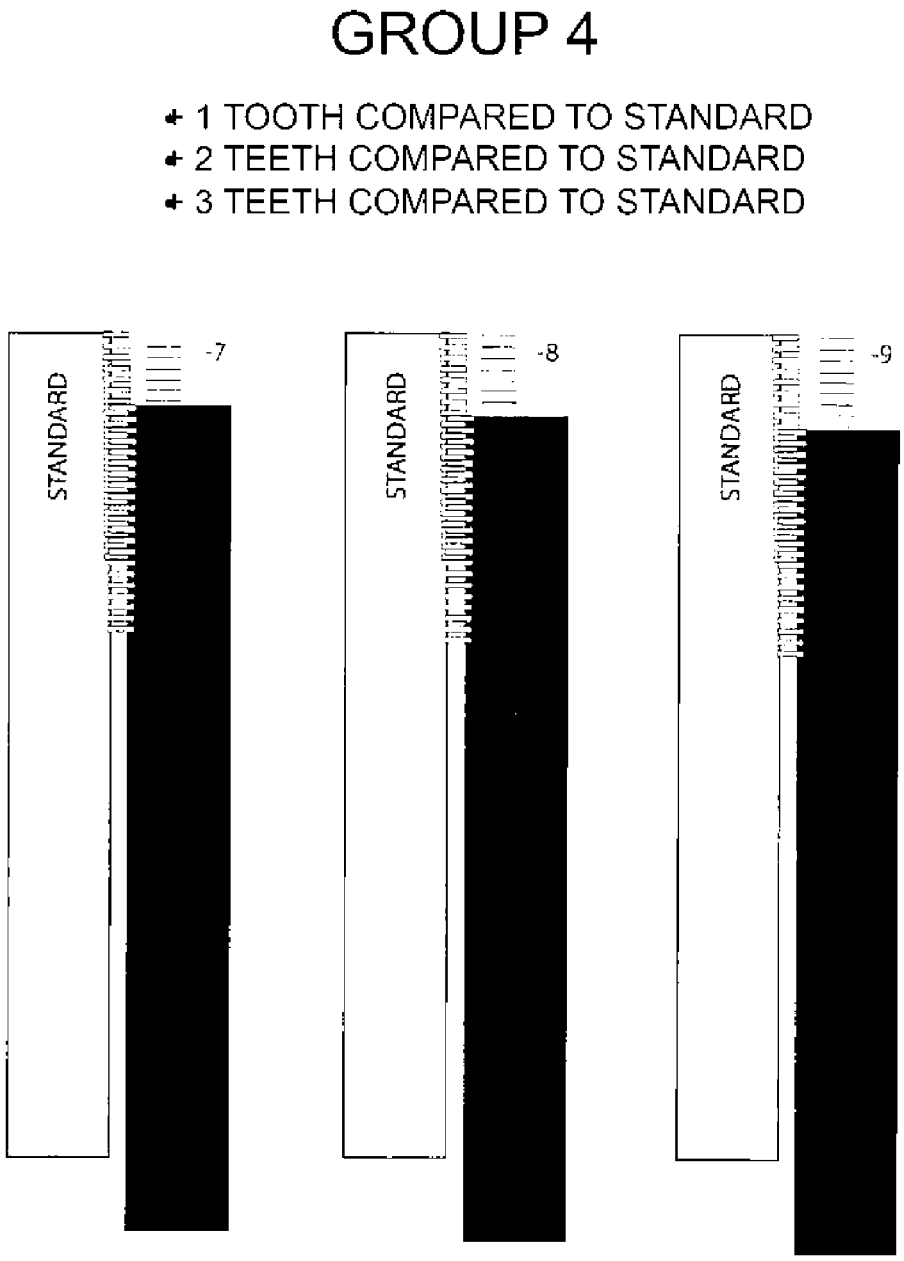
Figure 36:
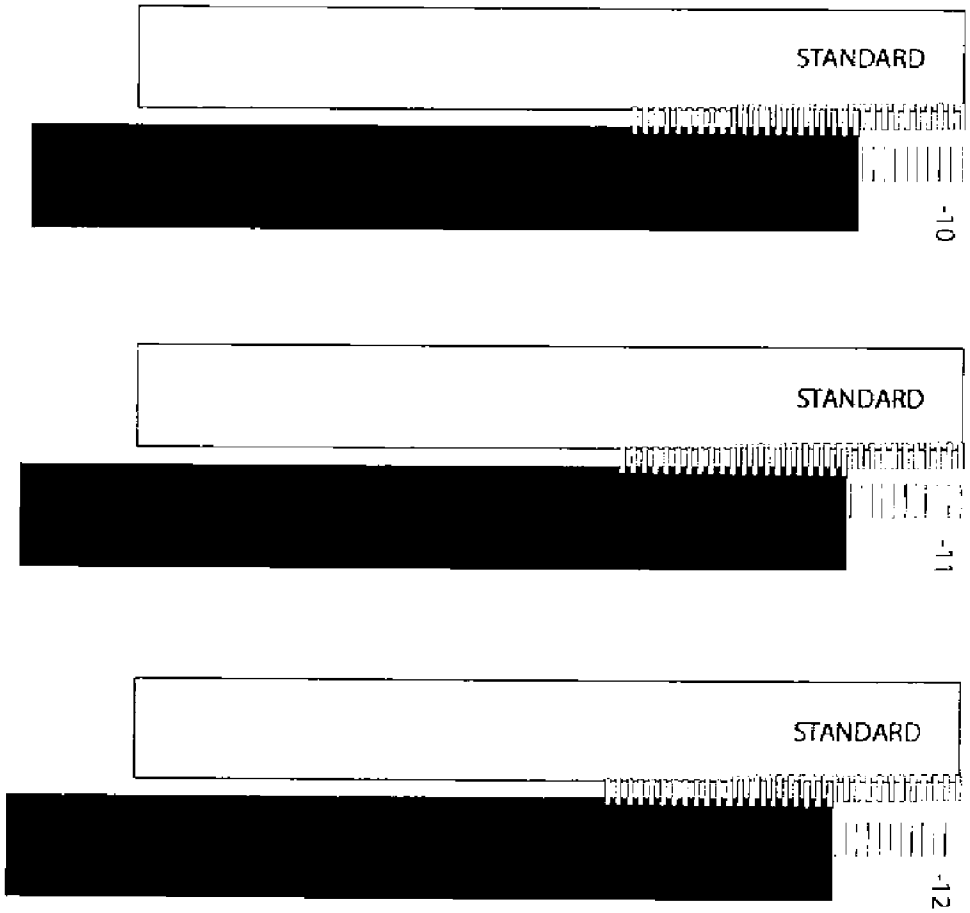

FIGS. 30 and 31 show a (for example fabric) strap which unites the back ends of the upper part or "skin" and is necessary to avoid that when fitting the shoe the force is applied on the zipper ends, instead the force is applied on the fabric strap;

Back Flap on Sole

Figure 22:
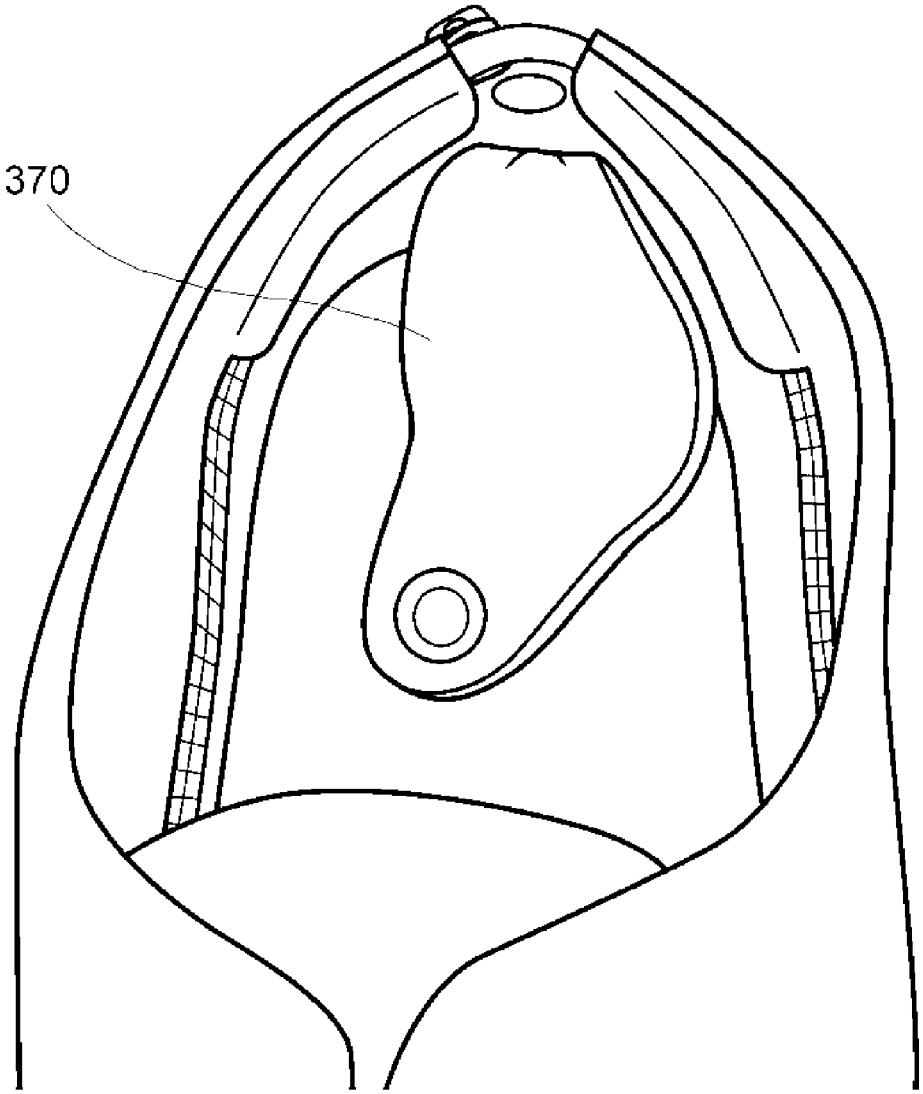
FIGS. 22, 23, 24, 25, 26, 27, 28 and 29 show a shoe incorporating a back comfort flap formed in accordance with the present invention.
Figure 23:
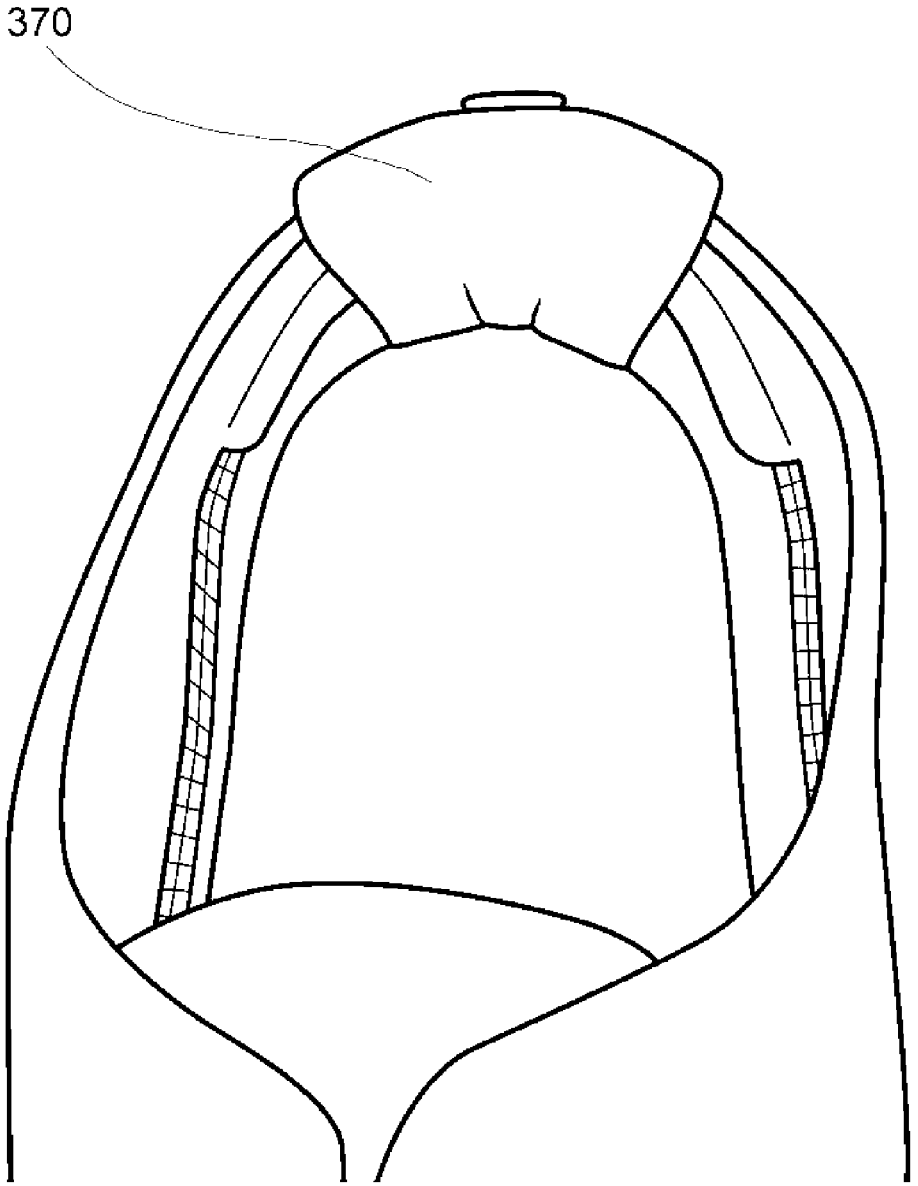
Figure 24:
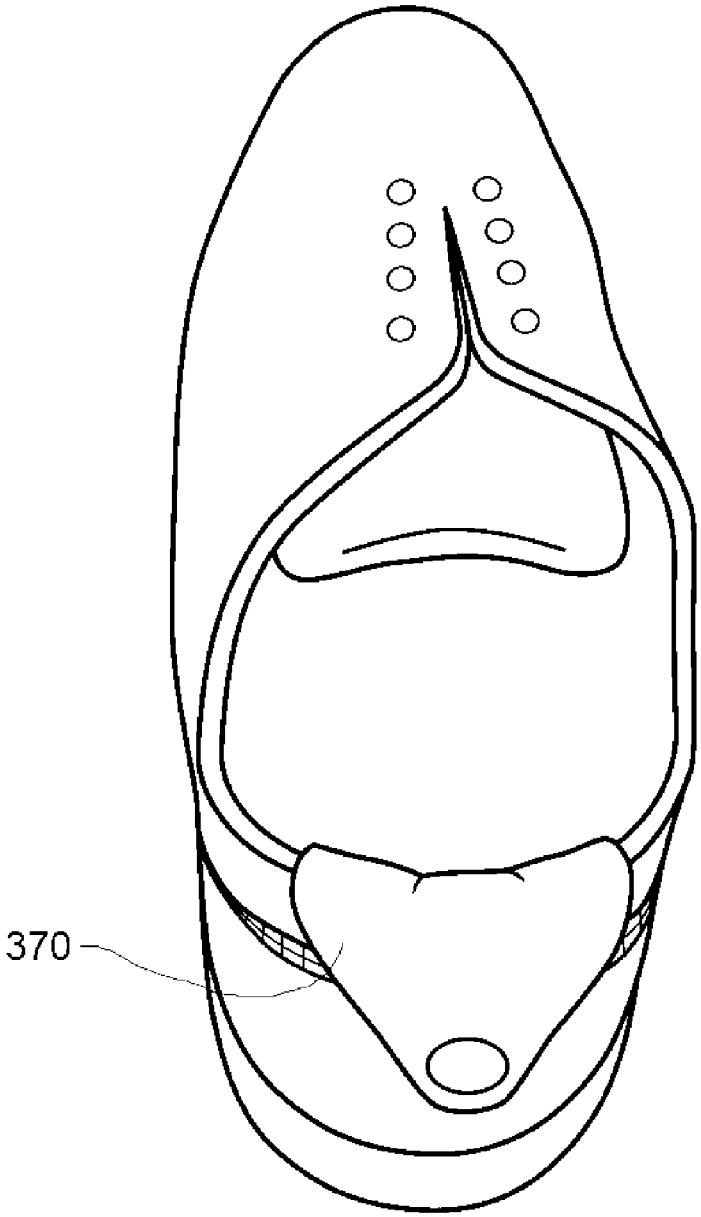
Figure 25:
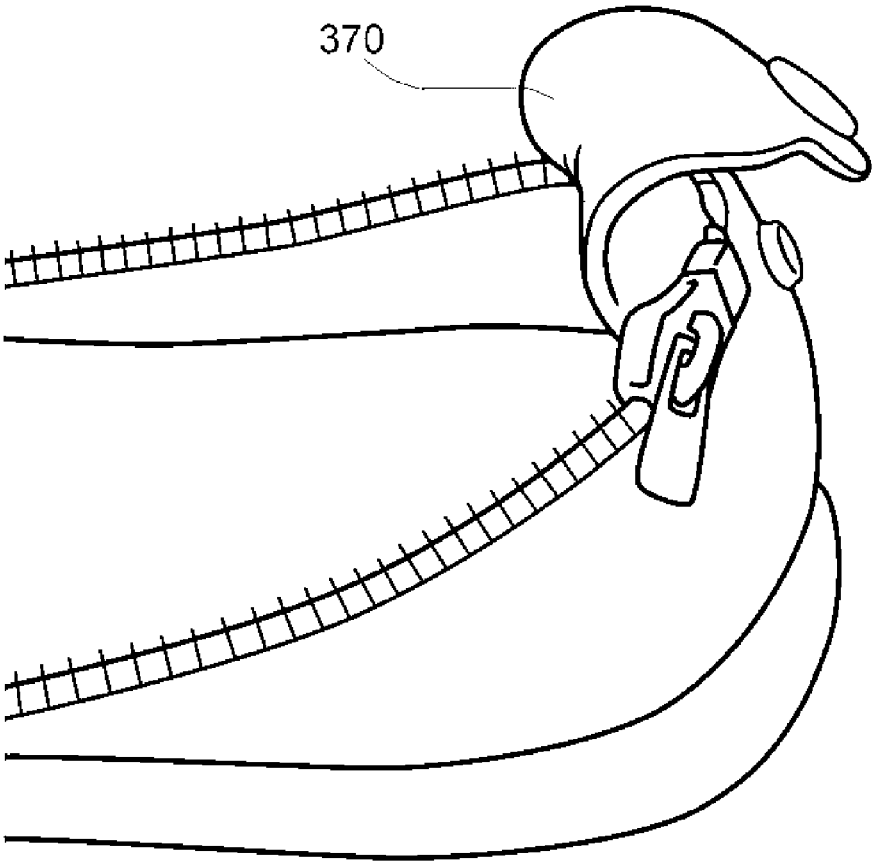
Figure 26:
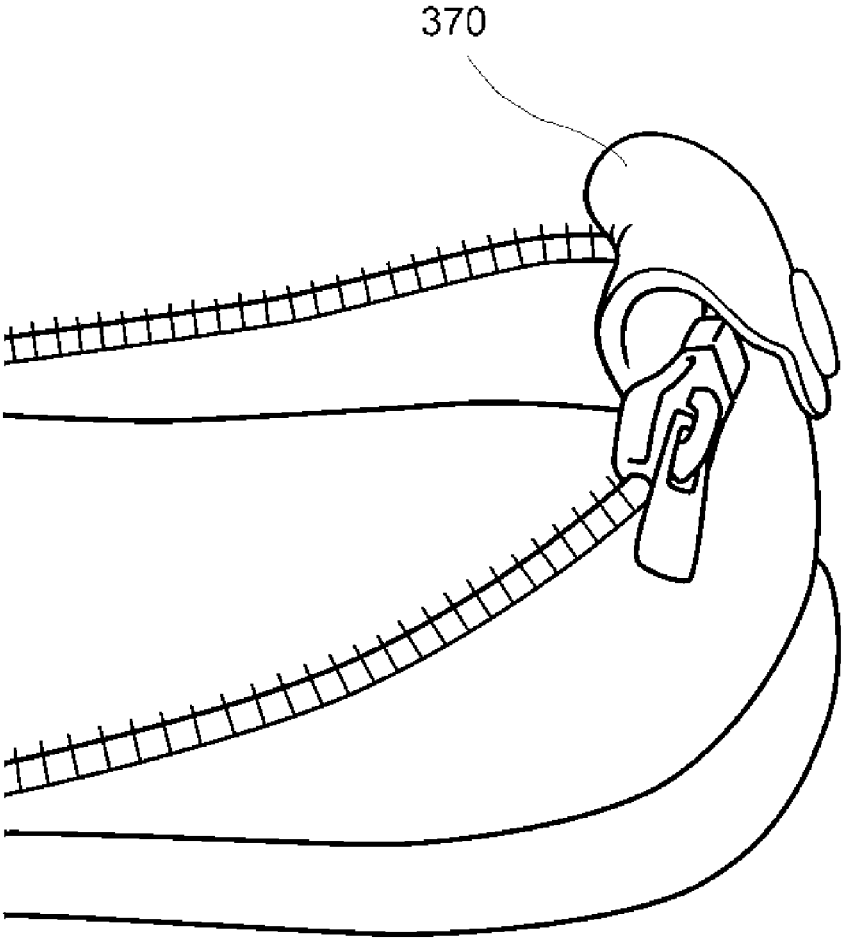
Figure 27:
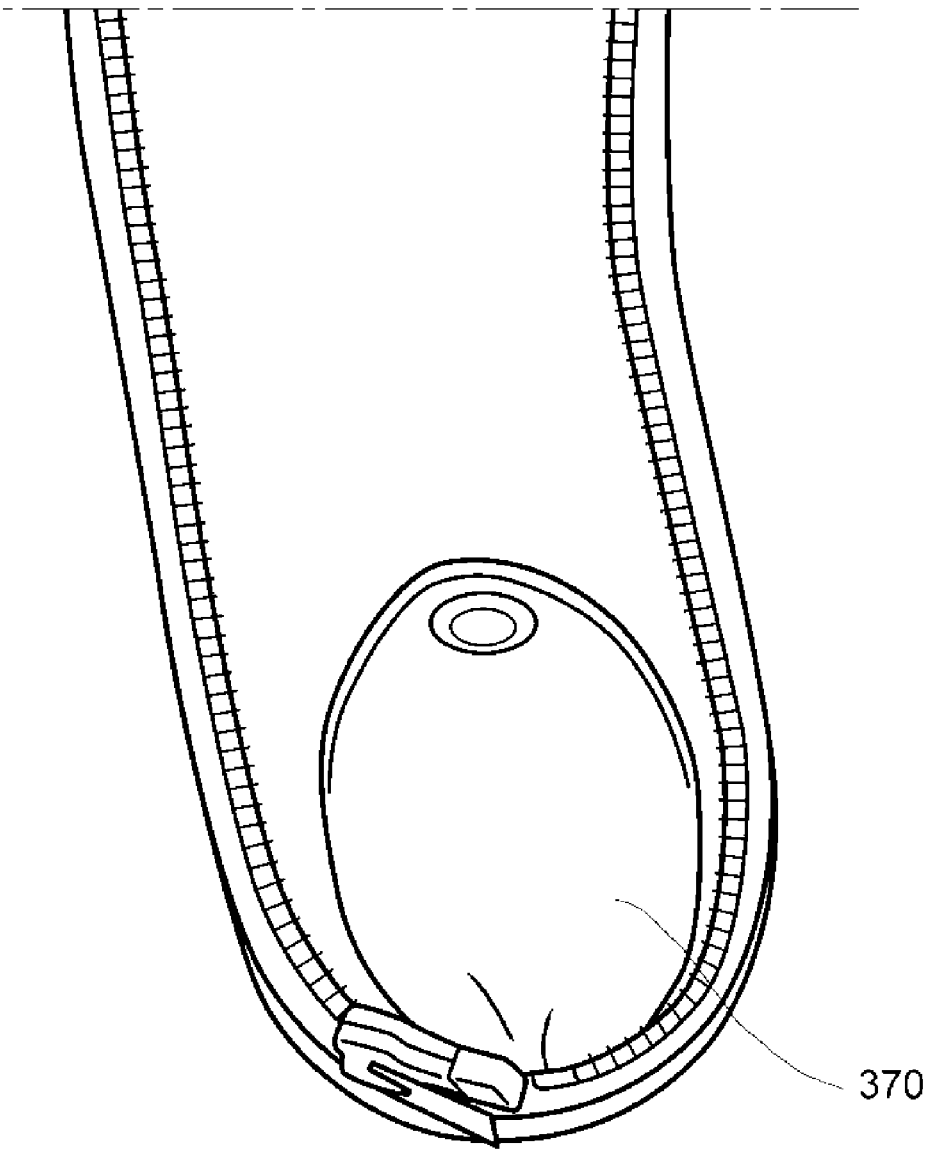
Figure 28:
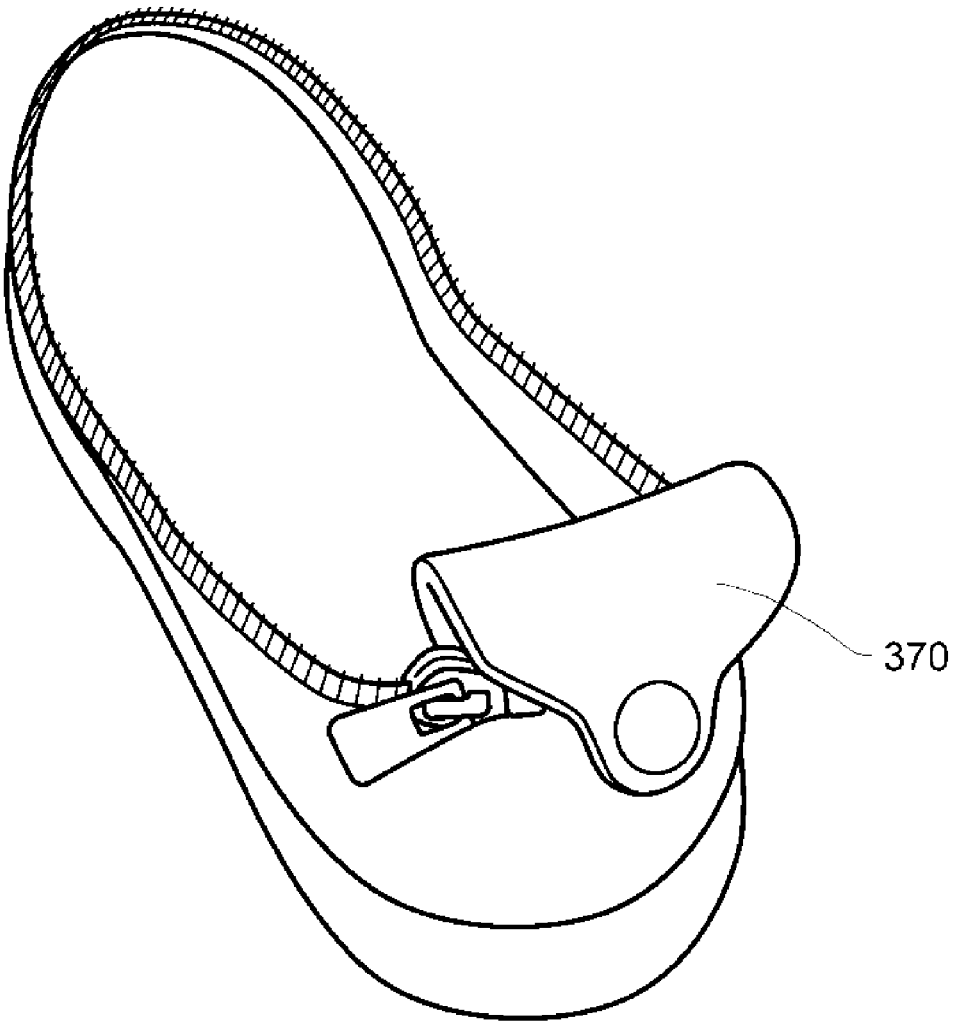
Figure 29:
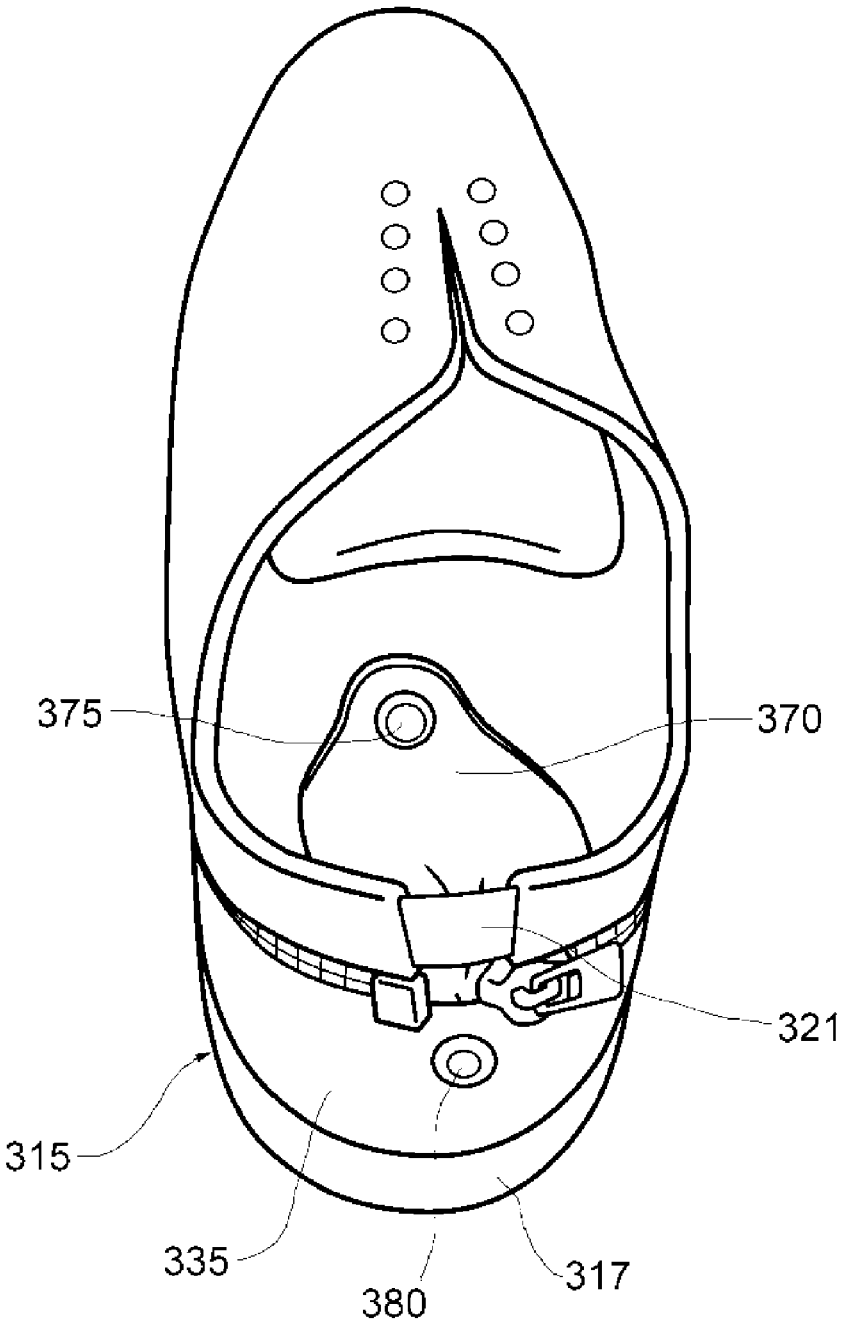

The flap is secured at one end (in the interior of the lower part) and is free at the other end (see FIGS. 22 and 27). An integrated a snap faster is provided (we could potentially use a magnet or other similar closure systems to serve the purpose). One part 375 of a snap fastener is provided at the free end of the flap 370 and the other fastener part 380 is provided on the outer face of the heel cap portion (best shown in FIG. 29). This arrangement allows access to the area beneath the flap with your hands and has allowed to bring closer the end and start point of the zipper and be able to place the start and end point of the zipper under the back flap. This allows: a) for more comfort as these metal parts get all covered by the flap and can't touch the foot; b) for a cleaner and better look of the shoe.

Fabric Strip Holding Ends of the Skin

A fabric strip 321 is provided to hold the ends of the skin 320 so that when fitting the shoe the force and stress is all applied on the fabric strip instead of being applied on the zipper ends which, after several fittings, would cause the zipper to break.

Zipper Sorting and Organization to Allow Universal Interchangeability

General Know how

The present inventor has discovered that in order to allow universal interchangeability between all skins and soles the spacing between the teeth of the zipper must remain the same among different production batches of zippers. This is impossible because there is always a slight variation in the spacing between the zipper teeth among different production batches of zippers and also within the same production batch.

The present invention provides a method to sort the zippers that are within this spacing variable in order to guarantee the interchangeability between all skins and soles.

Zippers are commonly produced and cut into pieces according to a set length. If you separate two zippers which were cut to the same length and match them together they won't match perfectly because even though they have the same length they have different number of total teeth because the space between each teeth is different.

The variable of teeth number for a length of 75 cm, which is the necessary length for the production of this product, is about fifteen teeth. If you use the zipper with less teeth on a skin, then use the zipper with more teeth on the sole and combine them, the match between the two zippers will not be straight, in fact the match will produce a curve and the zip with more teeth will wrap around the other zipper making the sole and the skin look warped and not aligned.

The present invention seeks to provide a perfect alignment between all skins and soles so as to be perfectly interchangeable.

Sorting Method—FIGS. 32 to 37

To achieve this target we firstly understood that the zippers had to be cut according to a set number of teeth, not according to a set length. If you cut two zippers according to a set length they will have same length but different number of teeth. If you cut two zippers according to a set number of teeth they will have different length but same number of teeth.

Two zippers with same number of teeth but different length can be stitched on a skin and sole, matched together and not produce a disalignment if the length difference is contained within 9 mm. Knowing that the distance between each teeth is of 1.5 mm, we also know the limit of 9 mm length difference between two zippers with same number of teeth corresponds to 6 teeth difference between two zippers with the same length. The allowance in the zipper production produces a variable of about fifteen teeth on 75 cm zippers so we have sorted these zippers into five groups, each group containing three teeth and each group serves a specific cluster of sizes—see FIG. 37. In order to do this we have selected a zipper which we take as standard to find out to which number of teeth corresponds each zipper.

Figure 37:
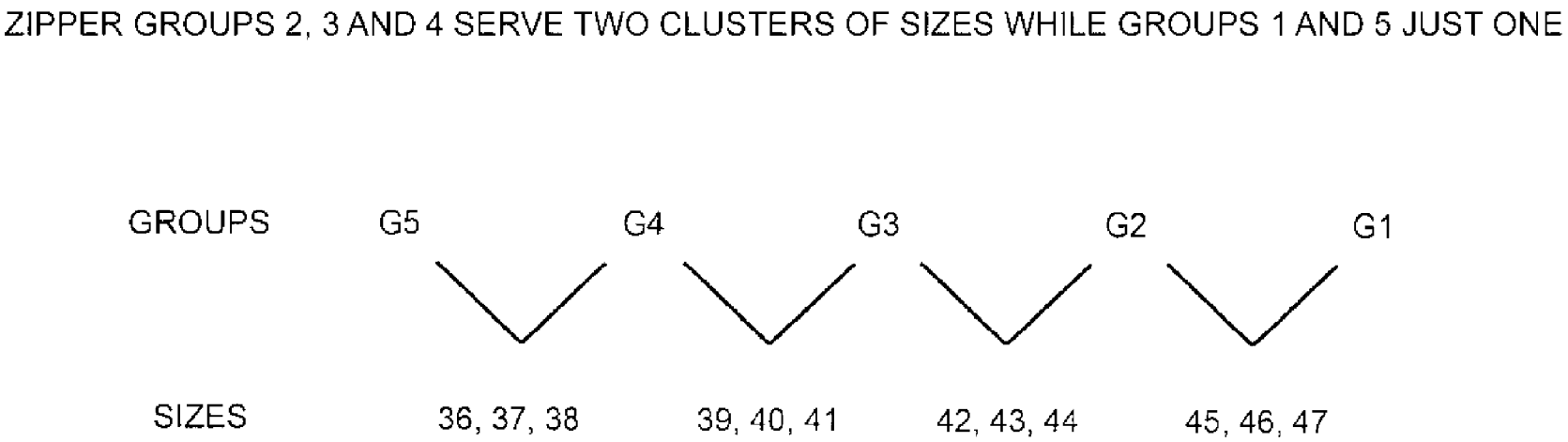
FIG. 37 illustrates a use of the zipper groups of FIGS. 32 to 36.

FIG. 37 shows the zipper group standard scheme.

The present invention provides the method of using cutting the zipper according to a set number of teeth and sorting the zipper teeth spacing variable into different groups in order to produce a guaranteed alignment all between skins and soles. FIG. 37 shows that zipper half groups are then allocated to specific shoe sizes (European shoe sizes are shown).

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. Footwear comprising a bottom part comprising a sole and an integral rear upper section, and a separate top part comprising a front upper section, the parts being releasably connected to each other by a releasable fastener, wherein each part provides a fastener half and each fastener half has a start and an end, wherein the rear upper section of the bottom part includes a heel cap portion, the top part comprises two ends at a rear part thereof and the ends are connected by a strap positioned between the start and end of the top half fastener, a movable flap is provided and extends over the inside surface of at least part of the heel cap portion, wherein the flap is flexible and movable between a fastened position and an unfastened position, a fastener being provided on the outside face of the heel cap portion for securing the flap in the fastened position, and wherein the releasable fastener is a zipper fastener, in which each fastener half has a zipper track with a plurality of teeth, and the number of teeth on the halves is exactly the same.

2. Footwear as claimed in claim 1, in which the flap extends over at least the insides of starts and ends of the fastener halves when the top and bottom parts are joined together.

3. Footwear as claimed in claim 2, in which the flap extends down over the outside face of the heel cap portion.

4. Footwear as claimed in claim 1, in which the fastener is a snap fastener.

5. Footwear as claimed in claim 1, in which the start and end of the releasable fastener are separated by a portion of the heel cap portion and located at or towards the top of the heel cap portion sides.

6. Footwear as claimed in claim 1, in which the integral rear upper section comprises at least one of a heel counter, at least part of a quarter, part of a vamp.

7. Footwear as claimed in claim 1, in which the front upper section comprises at least part of a vamp.

8. Footwear as claimed in claim 1, in which only two parts are provided.

9. Footwear as claimed in any claim 1, in which the upper part comprises a lacing arrangement.

10. Footwear as claimed in claim 1, in which the heel cap portion merges into a partial quarter and vamp portion which extends around the sides and front of sole, upstanding therefrom.

* * * * *